US005740254A

United States Patent [19]

Thompson et al.

[11] Patent Number: 5,740,254

[45] Date of Patent: Apr. 14, 1998

[54] SYSTEM FOR PROVIDING SOUND DISTINCTIONS FOR AUDITORY CONDITIONING AND METHOD THEREFOR

[76] Inventors: Billie M. Thompson; Kirk D. Thompson, both of 1635 E. Seldon La., Phoenix, Ariz. 85020

[21] Appl. No.: 664,640

[22] Filed: Jun. 17, 1996

[51] Int. Cl.[6] ..... H04K 5/02

[52] U.S. Cl. ..... 351/25; 381/74; 381/68.3; 381/151

[58] Field of Search ..... 381/151, 25, 19, 381/68.3, 97, 74

[56] References Cited

U.S. PATENT DOCUMENTS

| | | | |
|---|---|---|---|
| 3,710,034 | 1/1973 | Murry | 381/19 |
| 3,764,754 | 10/1973 | Mizumoto | 381/19 |
| 3,984,636 | 10/1976 | Turner et al. | 381/25 |
| 3,984,885 | 10/1976 | Yoshimura et al. | 381/25 |
| 5,521,982 | 5/1996 | Schiftan | 381/151 |

OTHER PUBLICATIONS

Dak Catalog, 1987, pp. 48–49.

*Primary Examiner*—Forester W. Isen

*Attorney, Agent, or Firm*—Harry M. Weiss; Jeffrey D. Moy; Harry M. Weiss & Associates, P.C.

[57] ABSTRACT

The present invention relates to an apparatus and method for providing sound distinctions for auditory conditioning. An audio storage media is used for storing multiple channel audio recordings. The audio storage media is played on a multiple channel audio player. A channel selection device is coupled to the multiple channel audio player for adjusting the strength of each channel of the multiple channel audio player. Headphones are coupled to the channel selection means for allowing the user of the apparatus to listen to at least one channel of the multiple channel audio recordings stored on the audio storage media. By separating the sounds into different channels, a user of the apparatus and method will be able to better distinguish sounds thus increasing the learning ability of the user.

12 Claims, 1 Drawing Sheet

SYSTEM FOR PROVIDING SOUND DISTINCTIONS FOR AUDITORY CONDITIONING AND METHOD THEREFOR

BACKGROUND OF THE INVENTION

1. Field of the Invention

This invention relates to apparatus and methods involving auditory conditioning and, more specifically, to an improved apparatus and method for separating sounds into different channels for auditory conditioning. By separating sounds into different channels, a user of the auditory conditioning apparatus and method will be able to better distinguish sounds thus increasing the learning ability of the user.

2. Description of the Prior Art

As is well known, sound is heard by a person because it passes through air to the person's ears (known as air conduction) and through cranial bones (known as bone conduction). Although the person's hearing may be substantially unimpaired by either sensory neural loss, conduction loss or osteoporosis, for example, the person may have a defective ability to learn.

If a person does not have a sensory neural loss, auditory conditioning is used to deal with an inability to discriminate between sounds of differing frequencies and to treat insensitivity to sound. The insensitivity may cause the person to experience a lack of motivation, lack of creativity, and a lack of energy. This insensitivity may have a psychological and/or a neurophysiological basis.

Auditory conditioning may also be used in dealing with a person's inability to tune out or to comfortably perceive sound at known frequencies within the audio frequency range, thereby causing a too open reception or a hypersensitivity to sound at the known frequencies. Typically, the hypersensitivity has a psychological and or neurophysiological basis.

When a person has an inability to attend and/or concentrate, it is very possible that this person has a reduced ability to listen to sounds transmitted via air conduction as compared to the ability to listen via bone conduction. This inability may also be dealt with by auditory conditioning apparatus and methods. This inability to attend and concentrate may have a psychological and/or neurophysiological basis.

A speech articulation and/or fluency defect is often related to a person's inability to perceive and distinguish sound signals clearly and to efficiently use the neurological pathways to the hearing center on the left side of the person's brain (left side hearing center) from the person's ears. The left side hearing center is believed to be the portion of a person's brain that controls the person's speech organs.

The most efficient neurological pathway to the left side hearing center is from the person's right ear. A neurological pathway from the person's left ear is less efficient. Through a process known as lateralization, auditory conditioning is used to cause a dominance of the neurological pathway from the right ear to the left side hearing center, known as right ear dominance. It is believed that many if not most people, and practically all singers, have right ear dominance.

Therefore, a need existed to provide a simple and inexpensive improved apparatus and method for auditory conditioning to increase the learning ability of a user. The apparatus and method must, preferably, be able to divide sounds into different channels for both air conduction and bone conduction. The apparatus and method must also be able to control the strength of each channel for the air and bone conduction. By separating sounds into different channels for both air and bone conduction, and by controlling the strength of each channel, a user of the apparatus and method will be better able to listen to distinctions in sounds. This will help increase the ability of the user to learn the different sounds thereby increasing the learning ability of the user. This improved apparatus and method must, preferably, also help the user develop an efficient neurological pathway to the left side hearing center from the user's right ear (i.e., develop right ear dominance).

SUMMARY OF THE INVENTION

In accordance with one embodiment of the invention, it is an object of the present invention to provide an improved apparatus and method for auditory conditioning to increase the learning ability of a user.

It is another object of the present invention to provide an improved apparatus and method for auditory conditioning which is relatively simple and inexpensive to use.

It is still another object of the present invention to provide an improved apparatus and method for auditory conditioning which will allow a user of the apparatus and method to listen to distinctions in sounds.

It is still another object of the present invention to provide an improved apparatus and method for auditory conditioning which is able to divide sounds into different channels for both air conduction and bone conduction.

It is still another object of the present invention to provide an improved apparatus and method for auditory conditioning which independently controls the strength of the channel for air conduction and the strength of the channel for bone conduction.

It is still another object of the present invention to provide an improved apparatus and method for auditory conditioning which will help the user develop an efficient neurological pathway to the left side hearing center from the user's right ear (i.e., develop right ear dominance).

BRIEF DESCRIPTION OF THE PREFERRED EMBODIMENTS

In accordance with one embodiment of the present invention, an apparatus for providing sound distinctions for auditory conditioning is disclosed. The apparatus is comprised of audio storage means for storing multiple channel audio recordings. The multiple channel audio recordings have one channel for air conduction and one channel for bone conduction. Multiple channel audio player means are provided for playing the multiple channel audio recordings stored on the audio storage means. Channel selection means are coupled to the multiple channel audio player means for adjusting the strength of each channel of the multiple channel audio player means. The channel selection means are comprised of first selection means for adjusting the strength of the signal for air conduction to the right ear of the user, second selection means for adjusting the strength of a signal for air conduction to the left ear of the user, and third selection means for adjusting the strength of a signal for bone conduction to the user. Listening means are coupled to the channel selection means for allowing a user of the apparatus to listen to at least one channel of the multiple channel audio recordings stored on the audio storage means. The listening means are comprised of right earphone means for sending the signal for air conduction to the right ear of the user, left earphone means for sending the signal for air conduction to the left ear of the user, and bone transmitter means for sending the signal for bone conduction to the head of the user.

In accordance with another embodiment of the present invention, a method for providing an apparatus for providing sound distinctions for auditory conditioning is disclosed. The method comprises the steps of: providing audio storage means for storing multiple channel audio recordings; providing multiple channel audio player means for playing the multiple channel audio recordings stored on the audio storage means; providing channel selection means coupled to the multiple channel audio player means for adjusting the strength of each channel of the multiple channel audio player means; and providing listening means coupled to the channel selection means for allowing a user of the apparatus to listen to at least one channel of the multiple channel audio recordings stored on the audio storage means. The method is further comprised of the step of providing audio storage means having multiple channel audio recordings wherein the multiple channel audio recordings have one channel for air conduction and one channel for bone conduction. The step of providing channel selection means may further comprise the steps of: providing first selection means for adjusting the strength of the signal for air conduction to the right ear of the user; providing second selection means for adjusting the strength of the signal for air conduction to the left ear of the user; and providing third selection means for adjusting the strength of the signal for bone conduction to the user. The step of providing listening means may further comprise the steps of: providing right earphone means for sending the signal for air conduction to the right ear of the user; providing left earphone means for sending the signal for air conduction to the left ear of the user; and providing bone transmitter means for sending the signal for bone conduction to the head of the user.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENT

Figure 1:
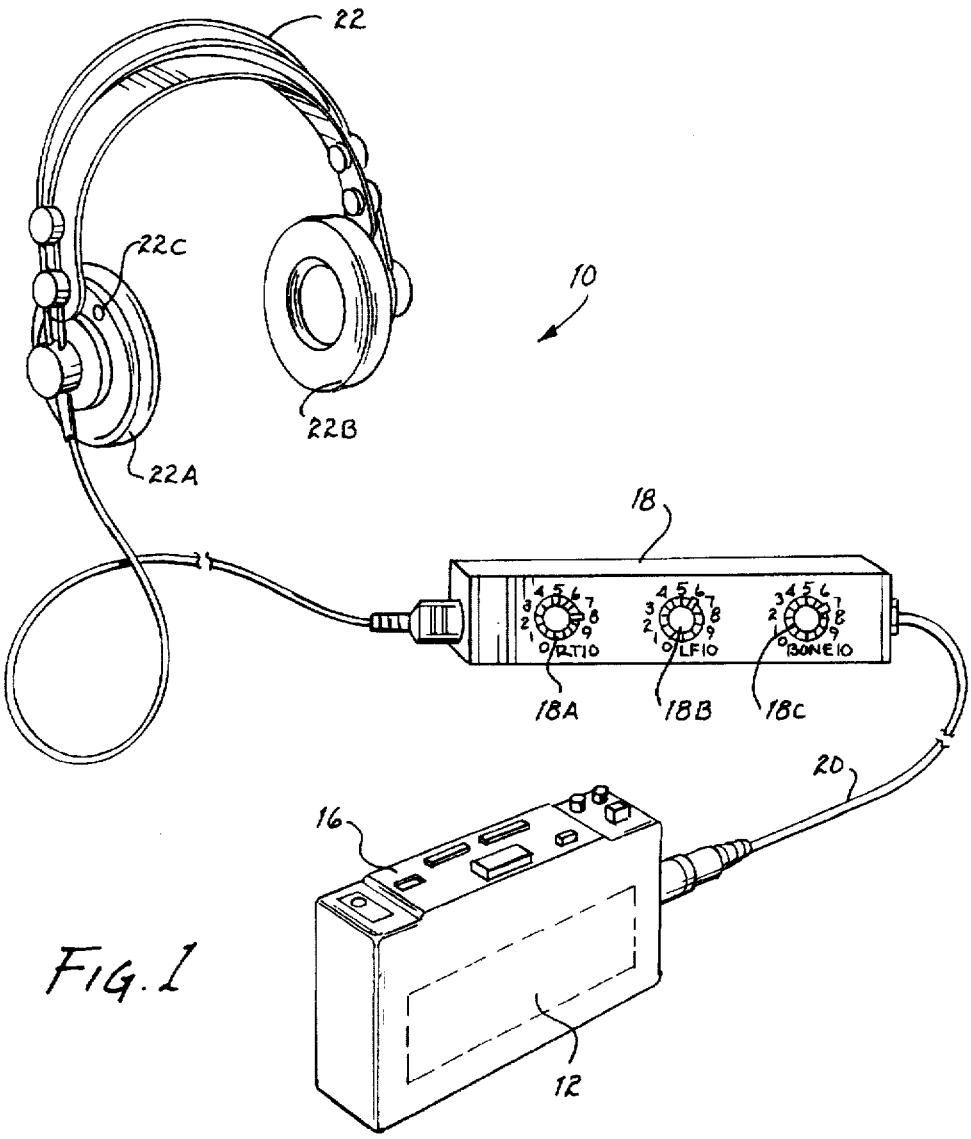
FIG. 1 is an elevated perspective view of an apparatus for providing sound distinctions for auditory conditioning.

Referring to FIG. 1, an apparatus for conditioning a person's auditory system 10 (hereinafter apparatus 10) is shown. The apparatus 10 is comprised of several elements in combination including an audio storage media 12. Some examples of an audio storage media 12 include, but are not limited to, magnetic tapes, compact discs, and vinyl records. The audio storage media 12 is used for storing multiple channel audio recordings. The multiple channel audio recordings stored on the audio storage media 12 are recorded so as to have at least one channel dedicated for air conduction and at least one channel dedicated for bone conduction. In the preferred embodiment of the present invention, prerecording of the tape channels will permit the channel for bone conduction to deliver a signal sooner than the channel that provides the signal for air conduction.

The audio storage media 12 are placed within or on a multiple channel audio player device 16. The multiple channel audio player device 16 is used for playing the multiple channel audio recordings stored on the audio storage media 12. Some examples of a multiple channel audio player device 16 are stereo tape players, stereo compact disc players, and stereo record players. These types of devices are well known to those skilled in the art and will not be further described.

A channel selection device 18 is coupled to the multiple channel audio player device 16 through a coaxial cable 20. The channel selection device 18 is used for adjusting the strength of the signal from each channel of the multiple channel audio player device 16. In the present embodiment, the channel selection device 18 is comprised of a first selection knob 18A for adjusting the strength of the audio signal for air conduction to the right ear of the user. A second selection knob 18B is provided for adjusting the strength of the audio signal for air conduction to the left ear of the user. In the preferred embodiment of the present invention, the audio signal for air conduction to the left ear of the user is a ratio of the signal for air conduction to the right ear of the user. Thus, the right ear will always receive a signal strength of 100% while the left ear will receive an audio signal which is a percentage of the audio signal to the right ear. The actual percentage received by the left ear is controlled by the second selection knob 18B. The channel selection device 18 is further comprised of a third selection knob 18C. The third selection knob is used for controlling the strength of the audio signal for bone conduction to the user.

Figure 2:
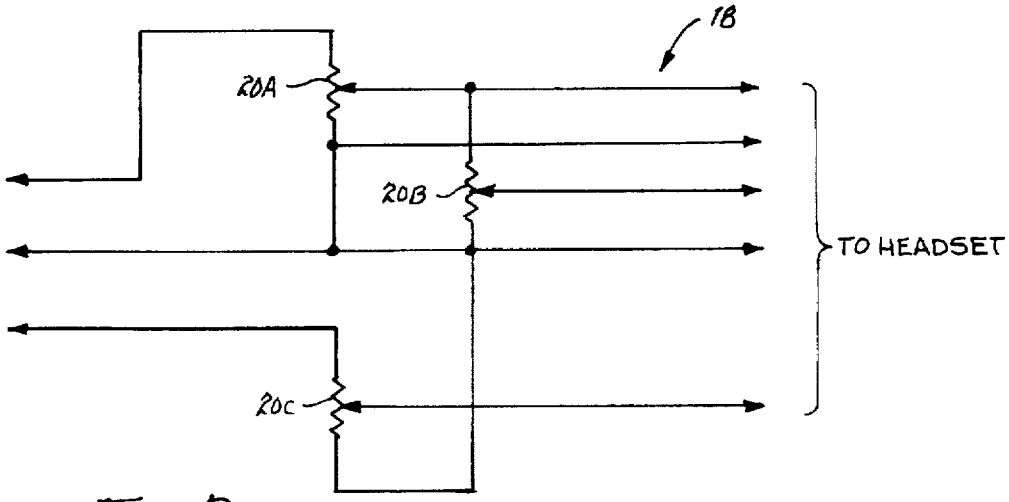
FIG. 2 is a simplified electrical schematic of the channel selection device used in the apparatus depicted in FIG. 1.

Referring to FIG. 2, a simplified electrical schematic of the channel selection device 18 is shown. The channel selection device 18 is comprised of three resistors 20A, 20B, and 20C. The resistor 20A is used by the first selection knob 18A for adjusting the strength of the signal for air conduction to the right ear of the user. The resistor 20B is used by the second selection knob 18B for adjusting the strength of the signal for air conduction to the left ear of the user. The resistor 20C is used by the third selection knob 18C for adjusting the strength of the signal for bone conduction to the head of the user.

Referring back now to FIG. 1, the output from the channel selection device 18 is sent to a headphone device 22. The headphone device 22 is used for allowing the user of the apparatus 10 to listen to at least one channel of the multiple channel audio recordings stored on the audio storage media 12. The headphone device 22 is comprised of a right earphone 22A for sending the signal for air conduction to the right ear of the user, a left earphone 22B for sending the signal for air conduction to the left ear of the user, and a bone transmitter 22C for sending the signal for bone conduction to the head of the user. The bone transmitter should be placed on the headphone device 22 so as to send the signal for bone conduction, for example, to the top of the head of the user. In the preferred embodiment of the present invention, the bone transmitter 22C should send a signal to at least the mastoid bone of the user.

The apparatus 10 is used for auditory conditioning in order to overcome some of the learning disabilities described above. The apparatus 10 may also be used to help individuals learn foreign languages. All languages, when spoken, emphasize a certain range of frequencies. By recording a foreign language on the audio storage media 12, and by emphasizing the proper frequencies, the user of the apparatus 10 may train his or her ears to the intonation and rhythm patterns of the foreign language. Thus, by using the apparatus, one will be able to more easily learn and speak a foreign language.

OPERATION

To use the apparatus 10, the audio storage media 12 is played on the multiple channel audio player device 16. The user of the apparatus 10 will place the headphones 22 over his or her ears. The first selection knob 18A is then adjusted in order to provide an audio signal to the right ear of the user which is comfortable to the user. The second selection knob 18B is then adjusted in a similar manner. The third selection knob 18C is then set at a level slightly higher than the first selection knob 18A since it takes a higher volume to produce sound on the bone conductor. The second selection knob 18B then should be lowered to a level below that of the first selection knob 18A in order to develop a good right ear dominance. The right ear being the most efficient ear for directing sound to the speech center of the brain. The tape player volume control depends on the volume capacity of the tape player or multiple channel audio player device 16.

While the invention has been particularly shown and described with reference to a preferred embodiment thereof, it should be understood by those skilled in the art that changes in form and detail may be made therein without departing from the spirit and scope of the invention.

What is claimed is:

1. An apparatus for providing sound distinctions for auditory conditioning comprising, in combination:

audio storage means for storing multiple channel audio recordings wherein said multiple channel audio recordings stored on said audio storage means has one channel for an air conduction signal and one channel for a bone conduction signal;

multiple channel audio player means for playing said multiple channel audio recordings stored on said audio storage means;

channel adjustment means coupled to said multiple channel audio player means for adjusting a strength of each channel of said multiple channel audio player means;

said channel adjustment means comprising:

first adjustment means for adjusting a strength of said signal for air conduction to a right ear of a user;

second adjustment means for adjusting a strength of said signal for air conduction to a left ear of said user; and third adjustment means for adjusting a strength of said signal for bone conduction to said user;

listening means coupled to said channel selection means for allowing a user of said apparatus to listen to at least one channel of said multiple channel audio recordings stored on said audio storage means; and wherein said audio storage means provides said bone conduction signal to said listening means sooner than said air conduction signal.

2. An apparatus for providing sound distinctions for auditory conditioning in accordance with claim 1 wherein said audio storage means is a magnetic tape.

3. An apparatus for providing sound distinctions for auditory conditioning in accordance with claim 1 wherein said audio storage means is a compact disc.

4. An apparatus for providing sound distinctions for auditory conditioning in accordance with claim 2 wherein said multiple channel audio player means is a tape player.

5. An apparatus for providing sound distinctions for auditory conditioning in accordance with claim 3 wherein said multiple channel audio player means is a compact disc player.

6. An apparatus for providing sound distinctions for auditory conditioning in accordance with claim 1 wherein said signal for air conduction to said left ear of said user is a ratio of said signal for air conduction to said right ear of said user.

7. An apparatus for providing sound distinctions for auditory conditioning in accordance with claim 1 wherein said listening means comprises:

right earphone means for sending said signal for air conduction to said right ear of said user;

left earphone means for sending said signal for air conduction to said left ear of said user; and bone transmitter means for sending said signal for bone conduction to a head of said user.

8. An apparatus for providing sound distinctions for auditory conditioning in accordance with claim 7 wherein said bone transmitter sends said signal for bone conduction to at least a mastoid bone of said user.

9. A method for providing an apparatus for providing sound distinctions for auditory conditioning comprising the steps of:

providing audio storage means for storing multiple channel audio recordings wherein said multiple channel audio recordings stored on said audio storage means has one channel for an air conduction signal and one channel for a bone conduction signal;

providing multiple channel audio player means for playing said multiple channel audio recordings stored on said audio storage means;

providing channel adjustment means coupled to said multiple channel audio player means for adjusting a strength of each channel of said multiple channel audio player means;

said step of providing channel adjustment means further comprising the steps of:

providing first adjustment means for adjusting a strength of said signal for air conduction to a right ear of a user;

providing second adjustment means for adjusting a strength of said signal for air conduction to a left ear of said user; and providing third adjustment means for adjusting a strength of said signal for bone conduction to said user;

providing listening means coupled to said channel selection means for allowing a user of said apparatus to listen to at least one channel of said multiple channel audio recordings stored on said audio storage means; and wherein said audio storage means provides said bone conduction signal to said listening means sooner than said air conduction signal.

10. The method of claim 9 wherein said signal for air conduction to said left ear of said user is a ratio of said signal for air conduction to said right ear of said user.

11. The method of claim 9 wherein said step of providing listening means further comprises the steps of:

providing right earphone means for sending said signal for air conduction to said right ear of said user;

providing left earphone means for sending said signal for air conduction to said left ear of said user; and providing bone transmitter means for sending said signal for bone conduction to a head of said user.

12. The method of claim 11 wherein said bone transmitter sends said signal for bone conduction to at least a mastoid bone of said user.

* * * * *